US008188388B2

(12) United States Patent
Shimizu

(10) Patent No.: US 8,188,388 B2
(45) Date of Patent: May 29, 2012

(54) OPERATION KEY STRUCTURE

(75) Inventor: Masahito Shimizu, Tokyo (JP)

(73) Assignee: NEC Corporation, Tokyo (JP)

( * ) Notice: Subject to any disclaimer, the term of this patent is extended or adjusted under 35 U.S.C. 154(b) by 380 days.

(21) Appl. No.: 12/441,295

(22) PCT Filed: Oct. 12, 2007

(86) PCT No.: PCT/JP2007/069940

§ 371 (c)(1),
(2), (4) Date: Mar. 13, 2009

(87) PCT Pub. No.: WO2008/044764

PCT Pub. Date: Apr. 17, 2008

(65) Prior Publication Data

US 2010/0006410 A1 Jan. 14, 2010

(30) Foreign Application Priority Data

Oct. 12, 2006 (JP) ..... 2006-279047

(51) Int. Cl.
*H01H 19/00* (2006.01)
*H01H 21/00* (2006.01)

(52) U.S. Cl. ..... 200/6 A; 200/517

(58) Field of Classification Search ..... 200/6 A, 200/512, 513, 516, 517; 338/47
See application file for complete search history.

(56) References Cited

U.S. PATENT DOCUMENTS 4,896,003 A * 1/1990 Hsieh ..... 200/6 A
5,496,977 A * 3/1996 Date et al. ..... 200/6 A
6,794,982 B2 * 9/2004 Inoue et al. ..... 338/47
2003/0085793 A1 5/2003 Inoue et al.

FOREIGN PATENT DOCUMENTS

JP 1994060031 A 8/1994
JP 2002117751 A 4/2002
JP 2002270070 A 9/2002
JP 2002304247 A 10/2002
JP 2003046628 A 2/2003
JP 2004086424 A 3/2004

OTHER PUBLICATIONS

Chinese Office Action for CN200780035439.6 dated Jan. 12, 2011.
International Search Report for PCT/JP2007/069940 mailed Dec. 11, 2007.

* cited by examiner

*Primary Examiner* — Felix O Figueroa

(57) ABSTRACT

A small-sized operation key, permits various kinds of inputs by a user to be detected and imparts the user with a tactile sensation in correspondence with each input to enable him/her to recognize his/her input. An operation key has a dome-like structure, a pressure detecting portion, a sheet member placed on the dome-like structure and pressure detecting portion, having a plate-like portion, and further having at least one first pusher and at least one second pusher formed on the lower surface of the plate-like portion, and an operating portion provided on the upper surface of the sheet member. In the operation key structure, the dome-like structure and the first pusher face each other and the pressure detecting portion and the second pusher face each other, and an initial load is applied to the pressure detecting portion by the second pusher.

11 Claims, 6 Drawing Sheets

OPERATION KEY STRUCTURE

This application is the National Phase of PCT/JP2007/069940, filed Oct. 12, 2007, which is based upon and claims priority from Japanese Patent Application No. 2006-279047 filed Oct. 12, 2006, which is incorporated herein in its entirety.

TECHNICAL FIELD

The present invention relates to an operation key structure for an electronic apparatus. More particularly, the present invention relates to an operation key structure for performing various kinds of input for an electronic apparatus, which executes a predetermined processing based on a predetermined program, such as a portable phone or portable play equipment.

BACKGROUND ART

In an electronic apparatus such as a portable phone or portable play equipment, various kinds of input by a user are accepted and then a program proceeds based on the input. With the high-functionalizing of the electronic apparatus, the user has needed to use various kinds of input. As the various kinds of input, switch input for switching ON/OFF, direction indicating input for indicating the directions of top, bottom, right and left, and scroll input for indicating the amount of displacement by performing a predetermined operation continuously are included. When the various kinds of input are performed, it is important to make a user recognize the input performed by the user as intended input, by giving a tactile sensation corresponding to the type of input to the user. Patent document 1 discloses an input device 100, as shown in FIG. 6, as an input device which is capable of giving a tactile sensation corresponding to various kinds of input.

The input device 100 of Patent document 1 includes a dome-like structure 400 on the central upper surface of an electrode 900 formed on a substrate 500, further, an elastic deformable body 300 and a control panel 200 are laminated. Circular support projections 700 for accepting the dome-like structure 400, which are dual of internal and external, and a circular electrode projection 800 located between two support projections 700 are integrally-molded near the outer edge of the elastic deformable body 300. In a normal state, the electrode projection 800 is held at the location separated from the electrode 900 by the support projections 700 which are dual of internal and external. A depressing bar 600 is formed at the location corresponding to the dome-like structure 400 of the control panel 200. When the user pushes the control panel 200 down, the depressing bar 600 depresses and deforms the dome-like structure 400. In the result, the user can obtain click feeling, and switch input is performed by the contact between the electrode projection 800 and the electrode 900. On the other hand, when the user depresses a part (outer edge) corresponding to the projections 700 and 800 of the control panel 200, the support projections 700 elastically-deform and the electrode projection 800 contacts with the electrode 900 of the substrate 500 so as to perform direction indicating input and the like.

Patent Document 1: Japanese Patent Application Laid-open No. 2002-304247

DISCLOSURE OF THE INVENTION

Problems to be Solved by the Invention

An electronic apparatus such as a portable phone or portable play equipment has become downsized as well as high-functionalized. As to downsizing, an input device for performing various kinds of input is not exception. The input device is desired to downsize its mounted area and also to be thin. Meanwhile, even if the input device is downsized, it needs to detect an input operation by the user accurately as well as to give a predetermined tactile sensation corresponding to various kinds of input by the user.

The present invention is invented in view of the above problems. It is therefore an object of the present invention to provide a downsized operation key structure which is capable of detecting various kinds of input by the user accurately as well as making a user recognize the input performed by the user by giving a predetermined tactile sensation corresponding to various kinds of input by the user.

Means for Solving the Problems

In order to achieve such an object, an operation key structure according to the present invention includes a dome-like structure, a pressure detecting portion arranged near the dome-like structure, a sheet member having at least one first pusher and at least one second pusher which are arranged on the dome-like structure and the pressure detecting portion and are formed on a plate-like portion and on the undersurface of the plate-like portion, and an operating portion arranged on the upper surface of the sheet member. In the operation key structure, the dome-like structure and the first pusher face each other, and the pressure detecting portion and the second pusher face each other. An initial load is applied to the pressure detecting portion by the second pusher. It is preferable to form the second pusher longer than the space between the undersurface of the plate-like portion and the pressure detecting portion and to deform the plate-like portion formed of an elastic body so as to apply an initial load to the pressure detecting portion by the second pusher. Further, it is preferable to form a concave portion for housing the deformed plate-like portion on the undersurface of the operating portion.

Effects of the Invention

The operation key structure according to the present invention is capable of providing an operation key having a small mounted area because the dome-like structure facing the first pusher is arranged near the pressure detecting portion facing the second pusher. Moreover, by applying an initial load to the pressure detecting portion by the second pusher, it is possible to detect minute change of pressure susceptibly by the pressure detecting portion. Meanwhile, in the case where a user inputs with a predetermined depressing force, the user can obtain click feeling clearly by the shape of the dome-like structure being inverting by the first pusher.

DESCRIPTION OF EXEMPLARY EMBODIMENTS

Hereinafter, exemplary embodiments of the invention will be explained with reference to the drawings.

FIG. 1 is a partial exploded perspective view showing each component by cutting off and taking apart main part of the operation key for an electronic apparatus according to this exemplary embodiment. In FIG. 1, an operation key 1 includes a front case 19, an operating portion 4, a key sheet 3, a flexible substrate 9 (a pressure detecting portion 10) and a substrate 2. The operation key 1 is suitable for being used as an operation key 1 for an electronic apparatus, which executes predetermined processing based on a predetermined program, such as a portable phone or portable play equipment. The operation key 1 performs definitive input indicating ON/OFF state and scroll input indicating the amount of operation in a predetermined direction.

In FIG. 1, the front case 19 is an external form of the operation key 1 and protects the operation key 1 from external forces as well as prevents trash and dust from invading inside of the operation key 1. In this exemplary embodiment, the front case 19 is formed by resin molding. In the center of the front case 19, an exposed hole 20 for exposing the operating portion 4 is provided.

The operating portion 4 transmits a force applied by the user to a dome-like structure or the pressure detecting portion 10 which work as an electrical contact via a definitive-input-pusher 7 or a scroll-input-pusher 8 which will be described later. FIG. 1A is an upward perspective view of the operating portion 4. FIG. 1C is a downward perspective view of the operating portion 4. The operating portion 4 is formed, in a circular shape, of metal such as aluminum and the like or of resin. At the opposing positions of the upper surface of the operating portion 4, two arrows are incused. In the case where the user performs definitive input, the user selects and pushes down either one of the arrows incused on the operating portion 4. On the other hand, in the case where the user performs scroll input, the user depresses the upper surface of the operating portion 4 lightly in a circumferential direction. Convex portions 5*a* and concave portions 5*b* are formed alternately in the circumferential direction of the undersurface of the operating portion 4, and both two arrows are incused on the upper surface of the operating portion 4 where the convex portions 5*a* are formed on the undersurface thereof. Note that the operating portion 4 may have any shape, if it is capable of performing a function of transmitting a force to the pushers 7 and 8. However, it is preferable to be disk-shaped in order to input the amount of operation relating to various directions. Moreover, in order to transmit operation by the user to the pushers 7 and 8 certainly, it is preferable to form the operating portion 4 of a stiffness material such as resin or metal.

The key sheet 3 includes a plate-like portion 18, a thick-walled portion 17, the definitive-input-pusher 7 and the scroll-input-pusher 8. In this exemplary embodiment, the key sheet 3 is formed by rubber molding using silicon rubber. FIG. 1A is an upward perspective view of the key sheet 3 and FIG. 1C is a downward perspective view of the key sheet 3. In the center of upper surface of the plate-like portion 18 of the key sheet 3, the operating portion 4 is bonded. On the other hand, on the undersurface of the plate-like portion 18, two definitive-input-pushers 7 and eight scroll-input-pushers 8 are formed. The operating portion 4 is fixed to the key sheet 3 in the positional relation that the definitive-input-pushers 7 are arranged under the convex portions 5*a* to which the arrows of the operating portion 4 are incused and the scroll-input-pushers 8 are arranged under the concave portions 5*b* formed on the operating portion 4. Further, eight scroll-input-pushers 8 are arranged, at equal spaces, on the circumference of a circle including two definitive-input-pushers 7. The thick-walled portion 17 is formed at the edge of the key sheet 3 and supports the front case 19 so that the upper surface of the front case 19 becomes on the same level as the upper surface of operating portion 4 in the case of assembling the operation key 1.

The definitive-input-pushers 7 are for performing definitive input indicating ON/OFF state effectively and have a function of transmitting a force applied by the user in a vertically-downward direction to near the top of a dome-like structure 15 which will be described later. In this exemplary embodiment, the definitive-input-pushers 7 are formed in frustum of circular cone. By forming it in frustum of circular cone, it becomes possible to consolidate the force in a vertically-downward direction applied by the user and to press the dome-like structure 15 effectively by the planer portion of the tip. Meanwhile, the scroll-input-pushers 8 are formed in frustum of circular cone as well as the definitive-input-pushers 7, but the scroll-input-pushers 8 are higher than the definitive-input-pushers 7 as is clear from FIG. 1C. This is to apply an initial load to the pressure detecting portion 10 in the case of composing the operation key 1. Note that the role of the scroll-input-pushers 8 will be explained later.

The pressure detecting portion 10 is formed by conductive-printing a pattern which reacts with low weighted on the flexible substrate 9. In this exemplary embodiment, a plate, which is not shown, is bonded to the undersurface of the flexible substrate 9. The pressure detecting portion 10 is formed at two points in a substantially semicircle shape so as to correspond to the aforementioned scroll-input-pushers 8. Further, the flexible substrate 9 has two relief holes 11 which are formed so as to be away from the pressure detecting portion 10. The relief holes 11 are to project the dome-like structure 15 described later. A connecting portion 13 is for electrically connecting the substrate 2 and the pressure detecting portion 10.

The substrate 2 mounts the components described above thereon and supports them. In this exemplary embodiment, the substrate 2 is formed, in a rectangular shape, of a print substrate for mounting an electronic circuit. At the point, on the upper surface of the substrate 2, which is in contact with the connecting portion 13 of the flexible substrate 9, a contact point 16 is formed of a print pattern such as copper. Further, at the point being just below the relief holes 11 of the flexible substrate 9, two dome-like structures 15 are fixed by being covered with a film from above. The dome-like structure 15 is in the shape of a reverse cup (dome-like shape). When a predetermined depressing force or more is applied to near the top portion, the shape of the dome-like structure 15 is inverted so that the top portion gets dented. When the depressing force disappears, the dome-like structure 15 restores to its original dome-like shape. In general, the shape-inverting of the dome-like structure 15 is used for definitive input by the user. Therefore, at least the undersurface near the top portion of the dome-like structure 15 needs to configure a conductive contact surface. In other words, when the shape of the top portion is inverted, the conductive contact surface becomes in contact with a print pattern provided at the side of the substrate 2 and input operation is detected. In this exemplary embodiment, the dome-like structures 15 are formed of a metal material. Note that the dome-like structures 15 do not always need to be formed of a metal material. For example, a dome may be formed of resin and the like, and a conductive material film may be formed near the center of the undersurface of the dome.

FIG. 2 shows an assembling process of the operation key 1. FIG. 2 is a partial cross-section view taken along the line A-A of FIG. 1. FIG. 2A shows the state before assembling the operation key 1. In FIG. 2A, the operating portion 4 is bonded to the key sheet 3 first. The operating portion 4 is bonded so that the scroll-input-pushers 8 are located under the concave portions 5*b* and the definitive-input-pushers 7 are located under the convex portions 5*a* on which the arrows are incused. Further, the key sheet 3 is fixed to the front case 19 so as to house the operating portion 4 in the exposed hole 20 of the front case 19. On the other hand, the flexible substrate 9 on which the pressure detecting portion 10 is formed is fixed to the substrate 2. Here, they are fixed in such a manner that the contact point 16 of the substrate 2 and the connecting portion 13 of the flexible substrate 9 are connected, and the top portions of the dome-like structures 15 project from the relief holes 11 of the flexible substrate 9. From this state, the front case 19 to which the key sheet 3 is fixed is built onto the substrate 2 on which the flexible substrate 9 is fixed. That is, the front case 19 is arranged such that the definitive-input-pushers 7 are located above the dome-like structures 15 and the scroll-input-pushers 8 are located above the pressure detecting portion 10. In this state, the front case 19 is further built in such that the thick-walled portion 17 of the key sheet 3 contacts the substrate 2.

FIG. 2B is a partial cross-section view showing the state after assembling the operation key 1. When the operation key is assembled, the scroll-input-pushers 8 abut on the pressure detecting portion 10 of the flexible substrate 9 before the undersurface of the thick-walled portion 17 hits the substrate 2. From this state, the front case 19 is further depressed downward. In this exemplary embodiment, because elastic modulus of the key sheet 3 is small and thickness of the plate-like portion 18 is thin, the plate-like portion 18 near the scroll-input-pushers 8 is locally-stretched, and the deformed plate-like portion 18 goes into the concave portions 5*b* formed on the operating portion 4 along with the scroll-input-pushers 8. As will be noted from FIG. 2B, the front case 19 is depressed until the undersurface of the thick-walled portion 17 contacts the substrate 2. When the upper surface of the front case 19 becomes almost on the same level as the upper surface of the operating portion 4 by the thick-walled portion 17 of the key sheet 3, assembling of the operation key 1 is completed, and the concave portions 5*b* is filled with the scroll-input-pushers 8. On the other hand, the stretched plate-like portion 18 near the scroll-input-pushers 8 generates a restoring force for restoring to its former state. The restoring force becomes a force for depressing the scroll-input-pushers 8 in a downward direction, and the stress in a downward direction becomes an initial load on the pressure detecting portion 10 via the scroll-input-pushers 8.

FIG. 3 is a partial cross-section view taken along the line B-B of FIG. 1 after assembling the operation key 1. In FIG. 3, the dome-like structures 15 arranged on the substrate 2 are located in the relief holes 11 of the flexible substrate 9. It prevents the shape of the dome-like structures 15 from being depressed by the planer portion of the flexible substrate 9 and inverted. With this structure, it becomes possible to arrange the flexible substrate 9 on which the pressure detecting portion 10 is formed closer to the substrate 2, between the substrate 2 and the key sheet 3 and to use a space between the substrate 2 and the key sheet 3 effectively. In this exemplary embodiment, the definitive-input-pushers 7 are in contact with the top portions of the dome-like structures 15 with a depressing force that is smaller than the depressing force with which the shape of the dome-like structures 15 is inverted. However, it may be configured such that the definitive-input-pushers 7 are not in contact with the dome-like structures 15, that is, in the suspension state.

Next, an input operation method of the operation key 1 will be explained. FIG. 4 is a front view showing a positional relation of the flexible substrate 9, the pushers 7 and 8, and the dome-like structures 15. In FIG. 4, each of two pressure detecting portion 10 shaded area) is being in contact with the four scroll-input-pushers 8 (dotted line) respectively, in a depressed state, in a circumferential direction at nearly equal spaces. As described above, the depressed state is attributed to a restoring force and the like of the plate-like portion 18 and becomes an initial load on the pressure detecting portion 10. By applying a definite initial load to the pressure detecting portion 10 preliminarily, it becomes possible to use a minute variation in load as detected amount directly. In other words, in the case where the user depresses the operating portion 4 lightly in a circumferential direction and the load applied from the scroll-input-pushers 8 to the pressure detecting portion 10 slightly-changes, the pressure detecting portion 10 is capable of detecting susceptibly the variation in load from the initial load value so as to enable scroll input.

Meanwhile, in FIG. 4, a part of the dome-like structures 15 (chain line) including the top portions arranged on the substrate 2 projects from the relief holes 11 of the flexible substrate 9. The definitive-input-pushers 7 (hatching area) of the key sheet 3 are being in contact with the projected part of the dome-like structures 15 with a depressing force that is smaller than the depressing force with which the shape of the dome-like structures 15 is inverted. In this state, when the user pushes the arrows of the operating portion 4 down, the corresponding definitive-input-pushers 7 depress the dome-like structures 15 by being pushed down by the convex portions 5*a*. In the case where the pushing down applies enough stress for making the shape of the dome-like structures 15 be inverted, near the top portions of the dome-like structures 15 is dented and the conductive contact surface formed on the undersurface of the tops of the dome-like structures 15 contacts a print pattern provided on the side of the substrate 2 so as to perform definitive input. At this time, the user can obtain click feeling by dent of the dome-like structures 15. It is possible to accomplish scroll input with slight stress because of an initial load, so the user can obtain click feeling more clearly when the definitive input is performed. In the case where the user pushes the area other than the arrows of the operating portion 4 down, a depressing force in a vertically-downward direction to the dome-like structures 15 applied by the definitive-input-pushers 7 is not enough to invert the shape of the dome-like structures 15, so definitive input is not detected by error.

As described above, the operation key 1 in the exemplary embodiment has a relatively simple structure using basic components such as the operating portion 4, the key sheet 3, the definitive-input-pushers 7, the scroll-input-pushers 8, the pressure detecting portion 10 and the dome-like structures 15, thereby, it becomes possible to accomplish definitive input (it is called click input) indicating ON/OFF state and scroll input indicating the amount of operation in a predetermined direction. By forming the relief holes 11 on the flexible substrate 9 on which the pressure detecting portion 10 is printed and by projecting a part of the dome-like structures 15 on the substrate 2, it becomes possible to closely-arrange the pressure detecting portion 10 and the dome-like structures 15 and to reduce the area where the operation key 1 is mounted. Further, by forming the relief holes 11 on the flexible substrate 9, it becomes possible to arrange the flexible substrate 9 between the substrate 2 and the key sheet 3 and to thin the operation key 1.

Moreover, the operation key structure according to this exemplary embodiment is a structure that the plate-like portion 18 of the key sheet 3 bends, and the scroll-input-pushers 8 apply an initial load to the pressure detecting portion 10, so it is possible to use a minute variation in load for the operating portion 4 for detecting scroll input as it is. The scroll input can be accomplished by slight stress, so the user can obtain click feeling more clearly by the dent of the dome-like structures 15. Further, as the scroll-input-pushers 8 support the definitive-input-pushers 7, unless a force more than a predetermined force is applied to the operating portion 4, it is possible to keep the state that the definitive-input-pushers 7 are in contact with the dome-like structures 15 with a depressing force that is smaller than the force with which the shape of the dome-like structures 15 is inverted. Therefore, even if the key sheet 3 is set to be considerably thin, it is capable of preventing the definitive-input-pushers 7 from making the dome-like structures 15 shape-invert by weight of the key sheet 3 or the pushers 7 and 8, or by a force other than the original definitive input. In this exemplary embodiment, further, as the concave portions 5*b* are formed on the operating portion 4, and the scroll-input-pushers 8 are housed in the concave portions 5*b* along with the extended plate-like portion 18, it is possible to form the thin-shaped operation key 1.

Further, in this exemplary embodiment, eight scroll-input-pushers 8 are formed in a circumferential direction at nearly equal spaces. Therefore, even where the user starts scroll input from any part of the operating portion 4, the detection can be achieved similarly. Note that the number of scroll-input-pushers is not limited to eight. If the scroll input by the user is detected properly, the number, the arrangement method and the like can be changed arbitrarily. Moreover, the pressure detecting portion 10 is formed on the flexible substrate 9 by being conductive-printed, which is not limited thereto. The pressure detecting portion 10 may be formed on the substrate 2 directly. Further, a connection between the flexible substrate 9 and the substrate 2 is performed by the connecting portion 13 on which the conductive material is printed and the contact point 16. Also, by providing a terminal on the flexible substrate 9 and the substrate 2, a connector connection may be performed. Furthermore, the front case 19 is provided in this exemplary embodiment, which may be omitted depending on the shape of the operation key 1 and the environment of usage.

Next, the operation key structure according to the second exemplary embodiment of the present invention will be explained. In the first exemplary embodiment, definitive input by depressing either one of two arrows of the operating portion and scroll input by depressing the operating portion lightly in a circumferential direction are possible. On the other hand, in this exemplary embodiment, an operating portion exclusively for definitive input, which is separated from the operating portion, is provided.

FIG. 5A is a partial exploded perspective view showing the operation key according to this exemplary embodiment. Further, FIG. 5B is a downward perspective view of the operating portion 4, and FIG. 5C is a downward perspective view of the key sheet 3. The components which are the same as that in the first exemplary embodiment have the same symbols as in the first exemplary embodiment. Hereinafter, components which differ from that in the first exemplary embodiment will be explained mainly. In FIG. 5, the operating portion 4 is formed in a doughnut shape and has four arrows incused on its upper surface in a circumferential direction at equal spaces. In this exemplary embodiment, a switch input portion 6 is arranged in the hole in the center of the operating portion 4. The switch input portion 6 is fixed to the key sheet 3 by being bonded. On the undersurface of the key sheet 3, four definitive-input-pushers 7 for definitive input are formed at the location corresponding to the arrows of the operating portion 4. Eight scroll-input-pushers 8 are formed so as to hold the definitive-input pushers 7 therebetween respectively. Moreover, in the center of the undersurface of the key sheet 3, a pusher for the switch input portion 6 (hereinafter, it will be described as a switch-input-pusher 14) is formed.

On the upper surface of the flexible substrate 9, four relief holes 11 are formed at the location corresponding to the definitive-input-pushers 7, and a relief hole 12 is formed at the location corresponding to the switch-input-pusher 14. Further, the pressure detecting portion 10 in a doughnut shape, which is divided into four parts for avoiding the relief holes 11, is formed on the upper surface of the flexible substrate 9 and just below the scroll-input-pushers 8. Furthermore, on the upper surface of the substrate 2, five dome-like structures 15 and 21 are arranged corresponding to the definitive-input-pushers 7 and the switch-input-pusher 14.

In this exemplary embodiment, the switch input portion 6 is formed, in a columnar shape, of metal such as aluminum or resin. The switch input portion 6 transmits a force in a vertically-downward direction applied by the user to the switch-input-pusher 14. In the case where the user performs definitive input by using the switch input portion 6, the user pushes the switch input portion 6 down by applying a stress that is more than a predetermined stress. By pushing down, the switch-input-pusher 14 displaces downward, and the shape of the dome-like structure 21 is inverted. With the shape of the dome-like structure 21 being inverted, the user can obtain click feeling. And by a contact between the conductive contact surface of the dome-like structure 21 and a print pattern provided on the side of the substrate 2, ON/OFF state is detected. Note that, in order to perform the input by the user effectively, it is preferable for the upper surface of the switch input portion 6 to be formed in a smooth concave shape so as to fit the finger. Further, as to the switch-input-pusher 14, the relief hole 12 and the dome-like structure 21, the basic structures are the same as those provided on the operating portion 4. In this exemplary embodiment, in order to enhance click feeling obtained by the switch input portion 6 compared to the click feeling obtained by performing definitive input using the operating portion 4, the diameter of the dome-like structure 21 is enlarged than that of the dome-like structures 15 for the operating portion 4, and accordingly the switch-input-pusher 14 and the relief hole 12 are formed slightly large.

As for the operation key 1, the basic principle of definitive input and scroll input using the operating portion 4 is the same as that of the first exemplary embodiment, so the details will be omitted. In other words, in the case where the user selects and depresses any one of four arrows of the operating portion 4, the definitive-input-pushers 7 in the depressed area displace downward, the shape of the dome-like structures 15 is inverted and then electrically contacts with the substrate 2. As a result, ON/OFF state is detected. On the other hand, in the case where the scroll input indicating the amount of operation in a predetermined direction is performed for the operating portion 4, it is transmitted from the scroll-input-pushers 8 to the pressure detecting portion 10 as it is, and then the amount of operation is detected based on the electrical characteristics of the flexible substrate 9.

As described above, in the operation key of this exemplary embodiment, in the case where the user selects the switch input portion 6 or any one of four arrows of the operating portion 4 and the definitive input is performed, the switch-input-pusher 14 or the definitive-input-pushers 7 depress the dome-like structures 21 and 15, and then the shapes of the dome-like structures 21 and 15 are inverted. By inverting the shapes of the dome-like structures 21 and 15, the user can obtain click feeling and the conductive contact surfaces of the dome-like structures 21 and 15 contact a print pattern provided on the substrate 2 so as to detect ON/OFF state. Meanwhile, in the case where the scroll input indicating the amount of operation in a predetermined direction is performed for the operating portion 4, the amount of operation is detected based on the electrical characteristics of the flexible substrate 9 just like the first exemplary embodiment.

This exemplary embodiment is capable of five kinds of definitive input which include the definitive input in four directions by the operating portion 4 and the definitive input by the switch input portion 6. In electronic apparatus such as a portable phone and portable play equipment, a predetermined operation input by the user is accepted and programs proceed based on the operation input. Therefore, it is preferable to perform more different kinds of operation input by one component. By employing the structure of the exemplary embodiment, it becomes possible to perform a lot of different kinds of operation input without increasing the number of components or enlarging the operation key.

As described above, the operation key structure according to the exemplary embodiments of the present invention is capable of accomplishing both input functions which are definitive input (click input) indicating ON/OFF state and scroll input indicating the amount of operation in a predetermined direction, by a relatively simple structure using basic components which includes the operating portion 4, the key sheet 3, the definitive-input-pushers 7, the scroll-input-pushers 8, the pressure detecting portion 10 and the dome-like structures 15. Here, as the relief holes 11 and 12 are formed on the flexible substrate 9 on which the pressure detecting portion 10 is printed and at least the top portions of the dome-like structures 15 and 21 are projected, it becomes possible to closely-arrange the pressure detecting portion 10 and the dome-like structures 15 and to make the mounted area of the operation key 1 be small. Further, by forming the relief holes 11 on the flexible substrate 9, it becomes possible to arrange the flexible substrate 9 between the substrate 2 and the key sheet 3 and to use the space effectively. Furthermore, as the scroll-input-pushers 8 support the key sheet 3 and the like, it becomes possible to apply an initial load to the pressure detecting portion 10 by using a restoring force of the plate-like portion 18 near the scroll-input-pushers 8. Therefore, it becomes possible to use a minute variation in load for the operating portion 4 in order to detect the scroll input. On the other hand, as the scroll input is accomplished with slight stress, the user can obtain click feeling more clearly by the dent of the dome-like structures 15.

Moreover, as the scroll-input-pushers 8 support the key sheet 3 and the like, unless a force more than a predetermined force is applied to the operating portion 4, it is possible to keep the state that the definitive-input-pushers 7 do not apply the depressing force with which the shape of the dome-like structures 15 is inverted. Therefore, even if the plate-like portion 18 of the key sheet 3 is set to be thin considerably, it is capable of preventing the definitive-input-pushers 7 from making the shape of the dome-like structures 15 be inverted by its weight or a force other than the force by the original definitive input. Further, as the concave portions 5*b* are formed on the operating portion 4, and the scroll-input-pushers 8 are housed in the concave portions 5*b*, it is possible to form the thin-shaped operation key 1.

In the exemplary embodiments described above, the key sheet 3, the definitive-input-pushers 7, the scroll-input-pushers 8, the switch-input-pusher 14 and the thick-walled portion 17 are formed of a structure integrally-molded with an elastic material such as silicon rubber. However, all of them are not always needed to be formed of an elastic material. That is, if at least a part of the plate-like portion 18 of the key sheet 3 is formed of an elastic material, operations based on a detection principle described above can be achieved. Therefore, it is possible to form the thick-walled portion 17 of a stiffness material such as metal or resin, for example.

Further, the pressure detecting portion 10 formed on the upper surface of the flexible substrate 9 may be also formed by any method as long as conductive layers can be formed. Since the pressure detecting portion 10 has only to detect the contact with the undersurface of the scroll-input pushers 8, so it may be formed in the minimum area needed for achieving this function. On the other hand, by forming the pressure detecting portion 10 entirely, productivity may be improved.

As described above, the present invention has been explained with reference to the exemplary embodiments (and the examples). However, the present invention is not limited to the above exemplary embodiments (and the examples). For the configuration and details of the present invention, various modifications that one skilled in the art can understand can be performed within the scope of the present invention.

DESCRIPTION OF SYMBOLS

Figure 1B:
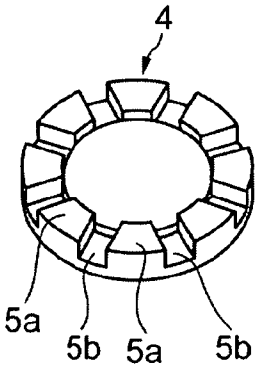
FIG. 1 is a partial exploded perspective view of an operation key according to a first exemplary embodiment of the invention.
Figure 1C:
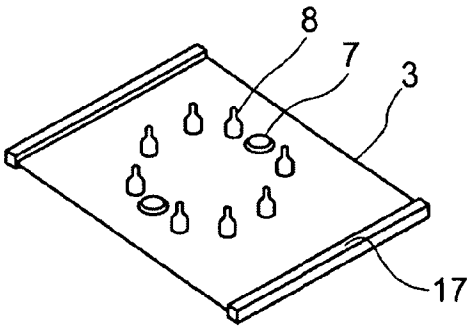
Figure 1A:
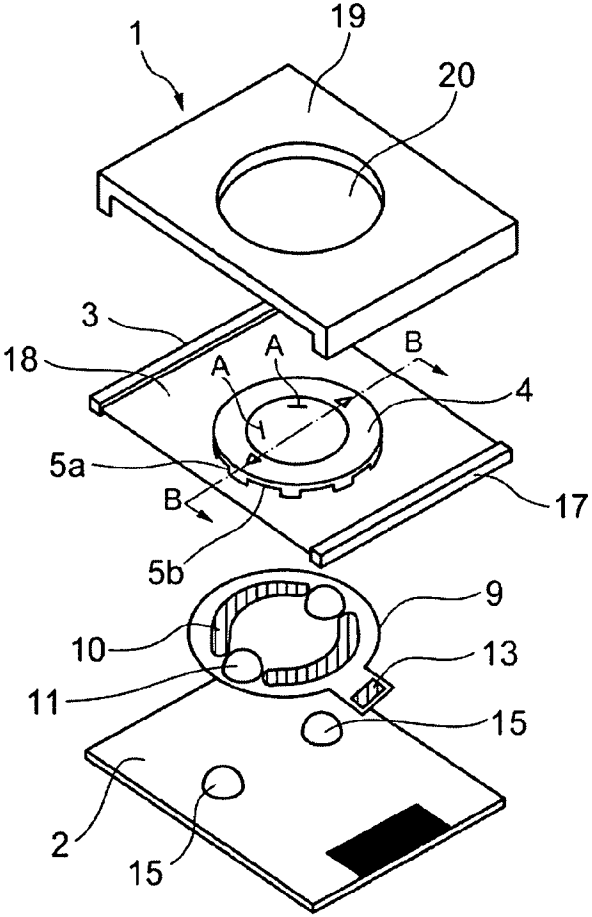
Figure 2A:
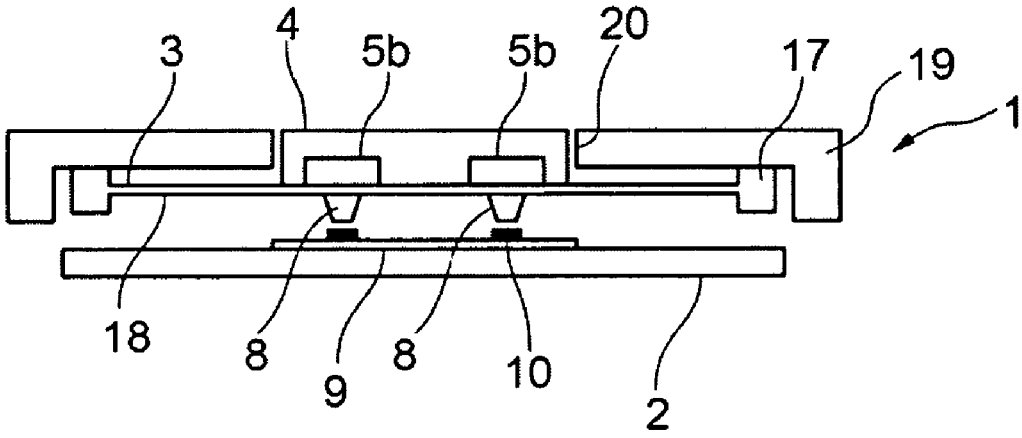
FIG. 2A is a cross-section view before assembling taken along the line A-A of FIG. 1.
Figure 2B:
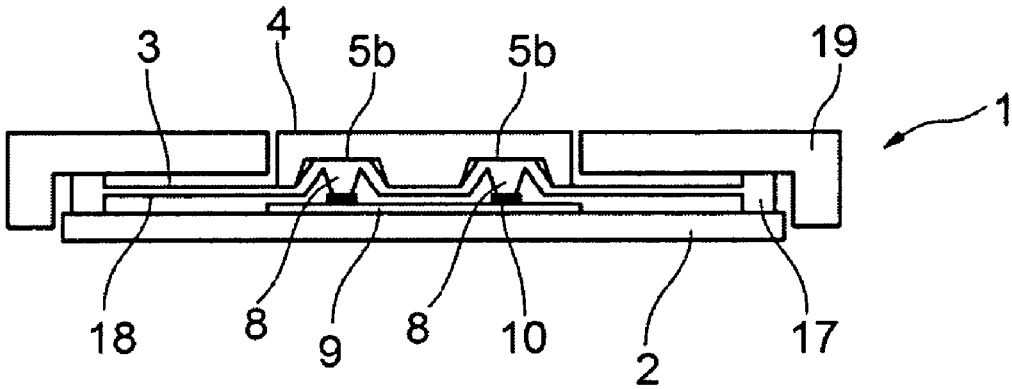
FIG. 2B is a cross-section view after assembling taken along the line A-A of FIG. 1.
Figure 3:
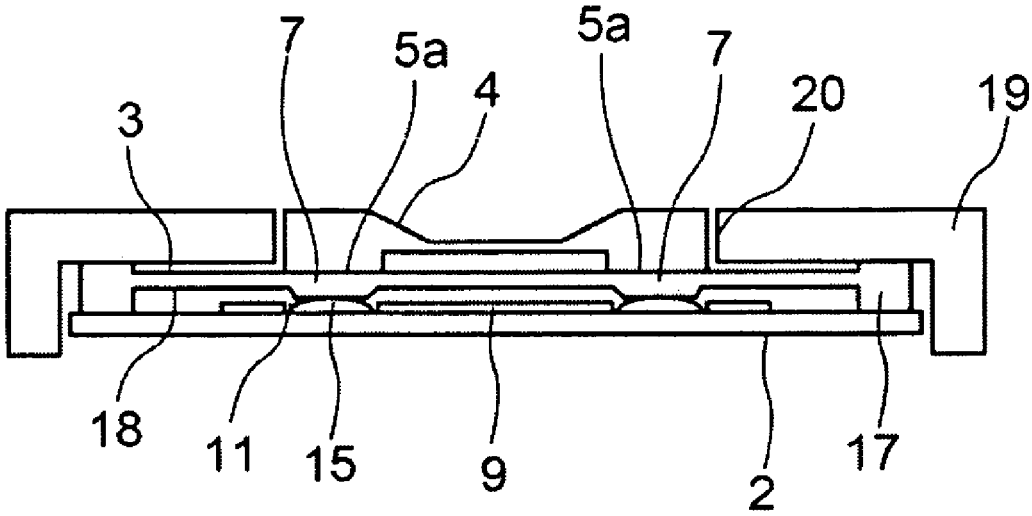
FIG. 3 is a cross-section view taken along the line B-B of FIG. 1.
Figure 4:
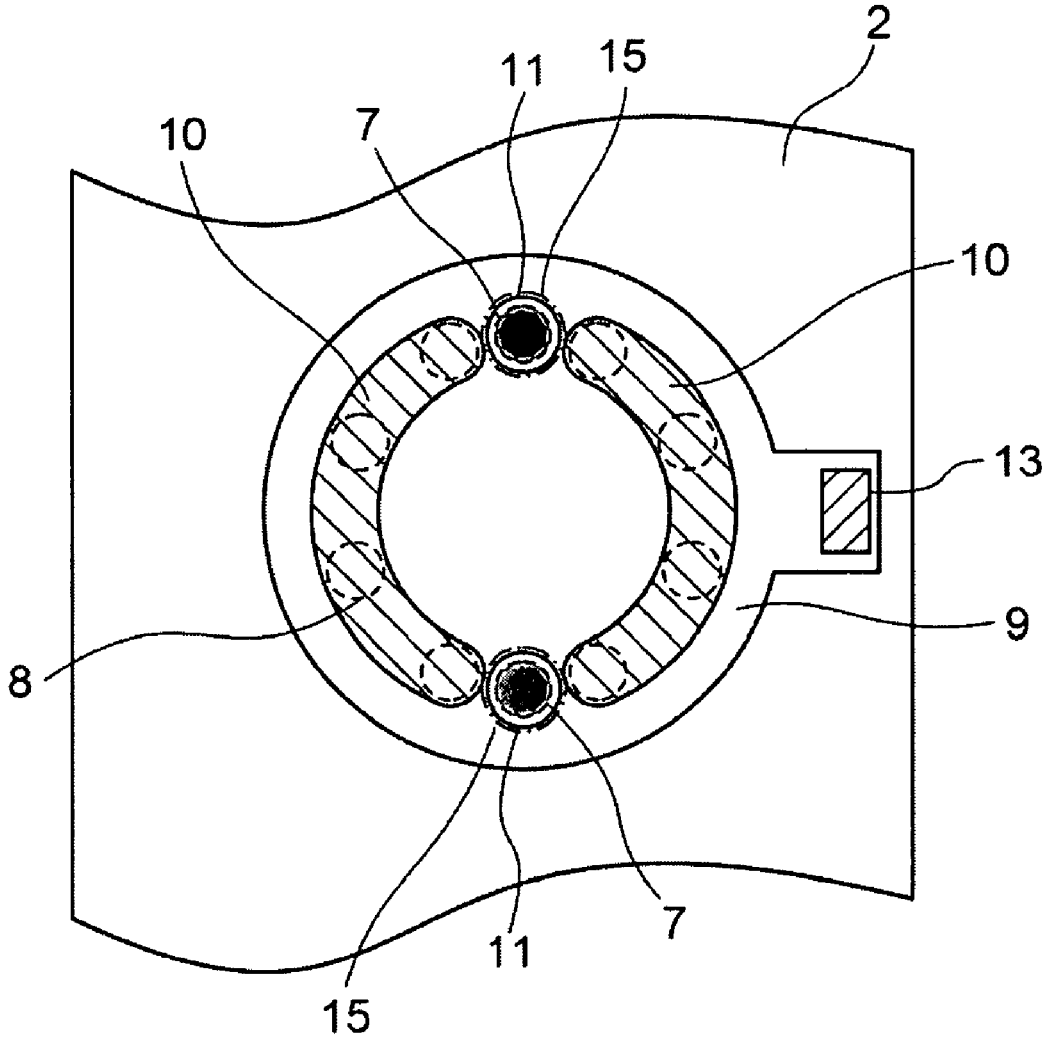
FIG. 4 is a front view showing a pressure detecting portion of the operation key according to the first exemplary embodiment of the invention.
Figure 5B:
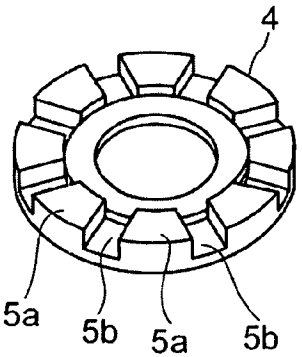
FIG. 5 is a partial exploded perspective view of the operation key according to a second exemplary embodiment of the invention.
Figure 5C:
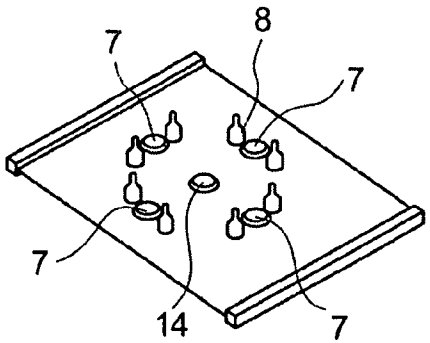
Figure 5A:
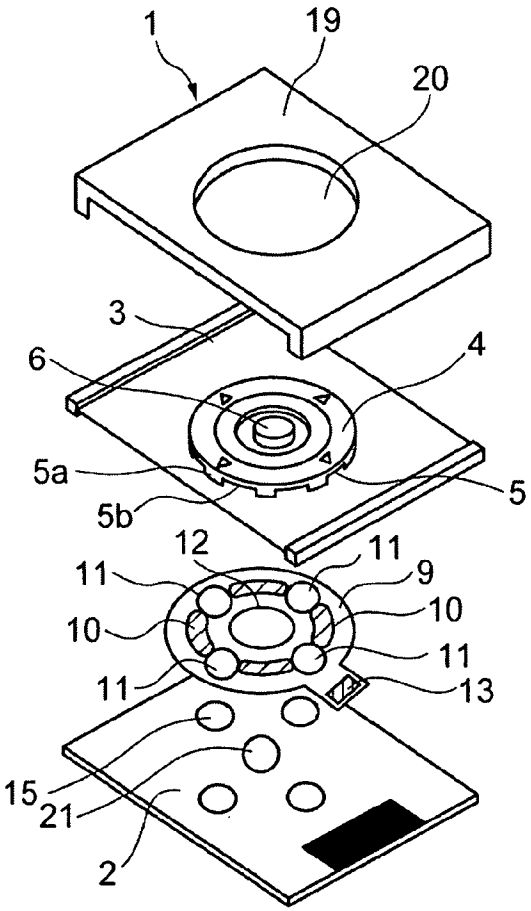
Figure 6:
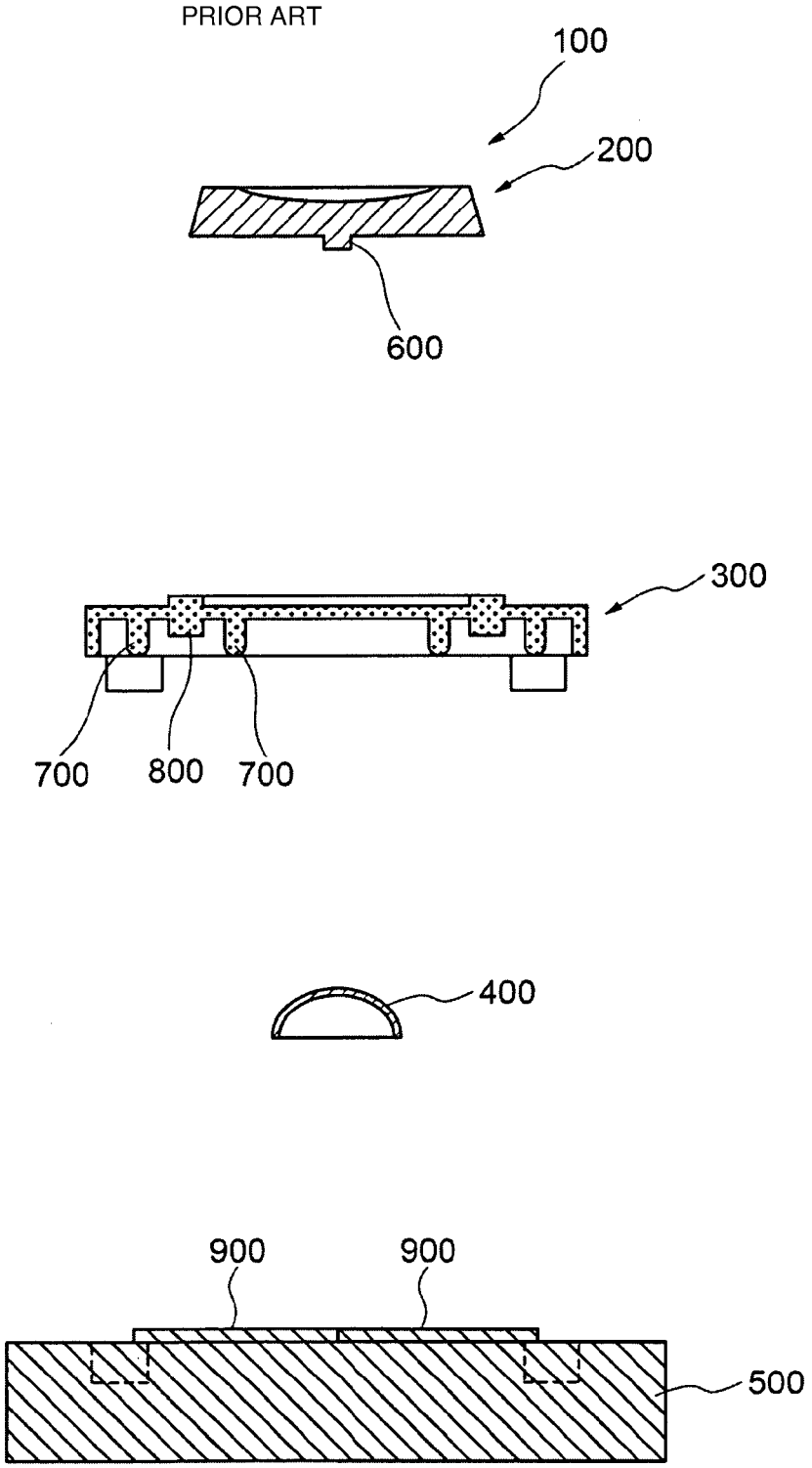
FIG. 6 PRIOR ART
FIG. 6 is an exploded cross-section view showing a relating input device 100.

1 operation key
2 substrate
3 key sheet
4 operating portion
5 concave portion
6 switch input portion
7 definitive-input-pusher
8 scroll-input-pusher
9 flexible substrate
10 pressure detecting portion
11, 12 relief hole
13 input portion
14 switch-input-pusher
15, 21 dome-like structure
16 contact point
17 thick-walled portion
18 plate-like portion
19 front case
20 exposed hole
100 input device
200 control panel
300 elastic deformable body
400 dome-like structure
500 substrate
600 depressing bar
700 support projection
800 electrode projection
900 electrode

The invention claimed is:

1. An operation key structure for performing various kinds of input for an electronic apparatus, comprising:

a dome-like structure and a pressure detecting portion functioning as an electrical contact;

a sheet member having a first pusher to depress the dome-like structure and a second pusher to depress the pressure detecting portion; and an operating portion having a convex portion to depress the first pusher and a concave portion to depress the second pusher, wherein— a part of the sheet member elastically-deforms so as to be housed in the concave portion of the operating portion, and an initial load by the second pusher is applied by a restoring force of the housed sheet member.

2. The operation key structure as claimed in claim 1, wherein the pressure detecting portion is formed on a flexible substrate, and the flexible substrate includes a relief hole for making a part of the dome-like structure penetrate to the side of the first pusher.

3. The operation key structure as claimed in claim 1, wherein the pressure detecting portion depressed by the second pusher is formed in a circumferential direction, and the dome-like structure is arranged at some points in the circumferential direction.

4. The operation key structure as claimed in claim 3, wherein the second pushers are formed on the pressure detecting portion in a circumferential direction at equal spaces.

5. The operation key structure as claimed in claim 1, wherein the dome-like structure and the pressure detecting portion are formed on a same substrate.

6. An operation key structure for performing various kinds of input for an electronic apparatus, comprising:

a dome-like structure and a pressure detecting portion functioning as an electrical contact;

a sheet member having a first pusher to depress the dome-like structure and a second pusher to depress the pressure detecting portion;

an operating portion having a convex portion to depress the first pusher and a concave portion to depress the second pusher, the operation key structure; and a front case having a hole for the operating portion for accepting the operating portion; and a substrate on which the dome-like structure depressed by the first pusher is formed, wherein the outer edge of the sheet member is sandwiched between the front case and the substrate, a part of the sheet member elastically-deforms so as to be housed in the concave portion of the operating portion, and an initial load is applied by a restoring force of the housed sheet member.

7. An operation key structure for performing various kinds of input for an electronic apparatus, comprising:

a dome-like structure and a pressure detecting portion functioning as an electrical contact;

a sheet member having a first pusher to depress the dome-like structure and a second pusher to depress the pressure detecting portion;

an operating portion having a convex portion to depress the first pusher and a concave portion to depress the second pusher, the operation key structure; and a front case having a hole for the operating portion for accepting the operating portion; and a substrate on which the dome-like structure depressed by the first pusher is formed, wherein the outer edge of the sheet member is sandwiched between the front case and the substrate, a part of the sheet member elastically-deforms so as to be housed in the concave portion of the operating portion, and an initial load is applied by a restoring force of the housed sheet member, a thick-walled portion is formed at the edge of the sheet member, and the thick-walled portion is arranged between the substrate and the front case and makes an upper surface of the front case and an upper surface of the operating portion be arranged on a same level.

8. The operation key structure as claimed in claim 1, wherein a switch input portion is provided in a center of the operating portion, and the dome-like structure is depressed by the switch input portion and functions as an electrical contact.

9. An operation key structure for performing various kinds of input for an electronic apparatus, comprising:

a dome-like structure and pressure detecting means functioning as an electrical contact;

a sheet member having a first pusher to depress the dome-like structure and a second pusher to depress the pressure detecting means; and operating means having a convex portion to depress the first pusher and a concave portion to depress the second pusher, wherein a part of the sheet member elastically-deforms so as to be housed in the concave portion of the operating means, and an initial load by the second pusher is applied by a restoring force of the housed sheet member.

10. An operation key structure for performing various kinds of input for an electronic apparatus, comprising:

a dome-like structure and pressure detecting means functioning as an electrical contact;

a sheet member having a first pusher to depress the dome-like structure and a second pusher to depress the pressure detecting means;

operating means having a convex portion to depress the first pusher and a concave portion to depress the second pusher, the operation key structure; and a front case having a hole for the operating means for accepting the operating means; and a substrate on which the dome-like structure depressed by the first pusher is formed, wherein the outer edge of the sheet member is sandwiched between the front case and the substrate, a part of the sheet member elastically-deforms so as to be housed in the concave portion of the operating means, and an initial load is applied by a restoring force of the housed sheet member.

11. An operation key structure for performing various kinds of input for an electronic apparatus, comprising:

a dome-like structure and pressure detecting means functioning as an electrical contact;

a sheet member having a first pusher to depress the dome-like structure and a second pusher to depress the pressure detecting means;

operating means having a convex portion to depress the first pusher and a concave portion to depress the second pusher, the operation key structure; and a front case having a hole for the operating means for accepting the operating means; and a substrate on which the dome-like structure depressed by the first pusher is formed, wherein the outer edge of the sheet member is sandwiched between the front case and the substrate, a part of the sheet member elastically-deforms so as to be housed in the concave portion of the operating means, and an initial load is applied by a restoring force of the housed sheet member, a thick-walled portion is formed at the edge of the sheet member, and the thick-walled portion is arranged between the substrate and the front case and makes an upper surface of the front case and an upper surface of the operating means be arranged on a same level.

* * * * *